United States Patent [19]

McMaster-Christie

[11] 4,092,085

[45] May 30, 1978

[54] FAUCET ASSEMBLY

[75] Inventor: Colin McMaster-Christie, Sunbury-on-Thames, England

[73] Assignee: Aqua-Marine Mfg. Limited, Toronto, Canada

[21] Appl. No.: 730,688

[22] Filed: Oct. 7, 1976

[30] Foreign Application Priority Data

| | | |
|---|---|---|
| Oct. 7, 1975 | United Kingdom | 41082/75 |
| Jan. 8, 1976 | France | 76 00361 |

[51] Int. Cl.[2] ..... F04B 49/06

[52] U.S. Cl. ..... 417/44; 200/61.86; 251/75; 251/313; 417/317

[58] Field of Search ..... 417/316, 317, 44; 200/61.86; 137/565, 625.4, 625.41; 251/313, 75, 250

[56] References Cited

U.S. PATENT DOCUMENTS

| | | | |
|---|---|---|---|
| 862,551 | 8/1907 | Gardner | 200/61.86 |
| 1,482,376 | 2/1924 | Anderson | 137/565 X |
| 1,888,542 | 11/1932 | Rosberg | 417/440 X |
| 2,434,771 | 1/1948 | Mueller et al. | 417/316 X |
| 2,840,101 | 6/1958 | Saylor | 137/565 X |
| 2,854,209 | 9/1958 | Erwin | 251/250 X |
| 3,272,241 | 9/1966 | Wagner | 137/565 X |
| 3,273,628 | 9/1966 | Puttfarcken | 200/61.86 X |
| 3,614,351 | 10/1971 | Wojcik | 200/61.86 |
| 3,700,002 | 10/1972 | Christie | 137/565 |

FOREIGN PATENT DOCUMENTS

| | | | |
|---|---|---|---|
| 296,666 | 2/1917 | Germany | 417/316 |

*Primary Examiner*—William L. Freeh
*Assistant Examiner*—Edward Look
*Attorney, Agent, or Firm*—Shoemaker and Mattare, Ltd.

[57] ABSTRACT

This invention provides a faucet assembly which includes a fluid passageway with valve means adapted to close and open the passageway, and a shaft which operates the valve means by rotating. Resilient biasing means are provided to the form of a spring-biased finger to induce the shaft to rotate in the direction closing the valve means whenever the shaft is less than a given angle away from the fully closed position. This given angle corresponds to a condition in which the passageway is at least partly opened.

29 Claims, 10 Drawing Figures

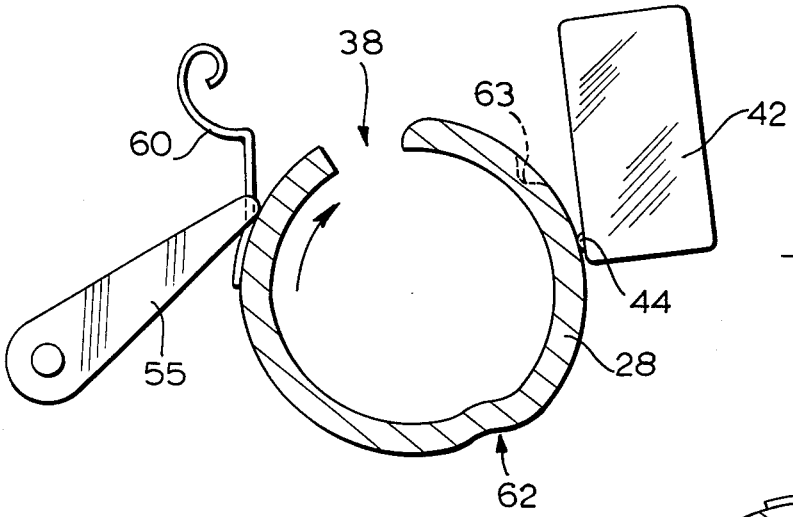
FIG. 4
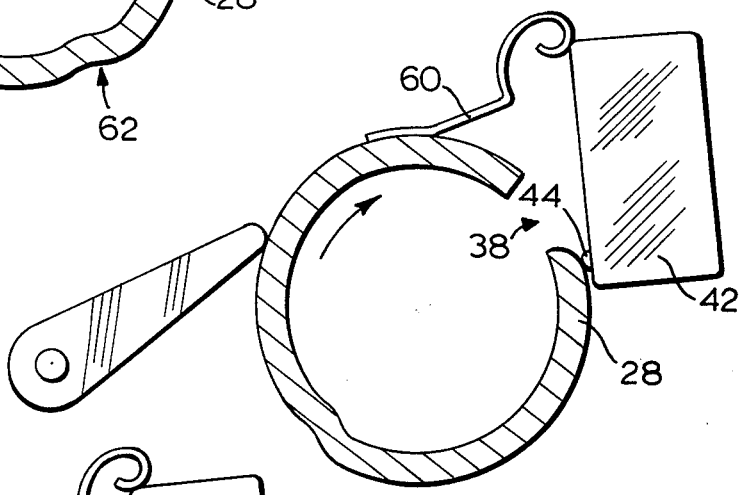
FIG. 5
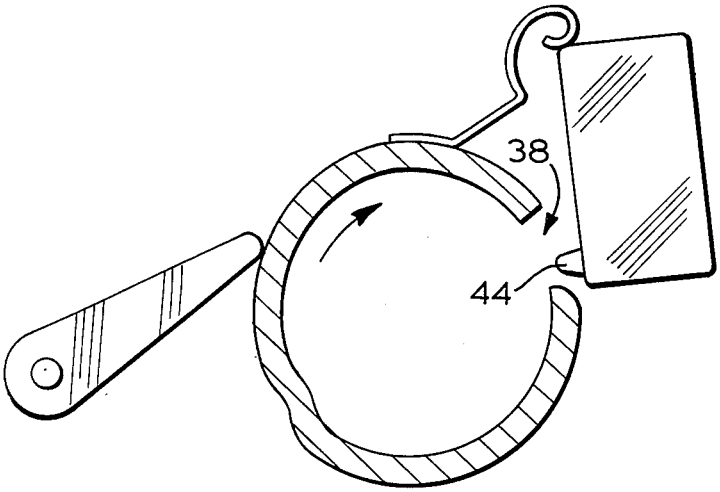
FIG. 6
FIG. 7
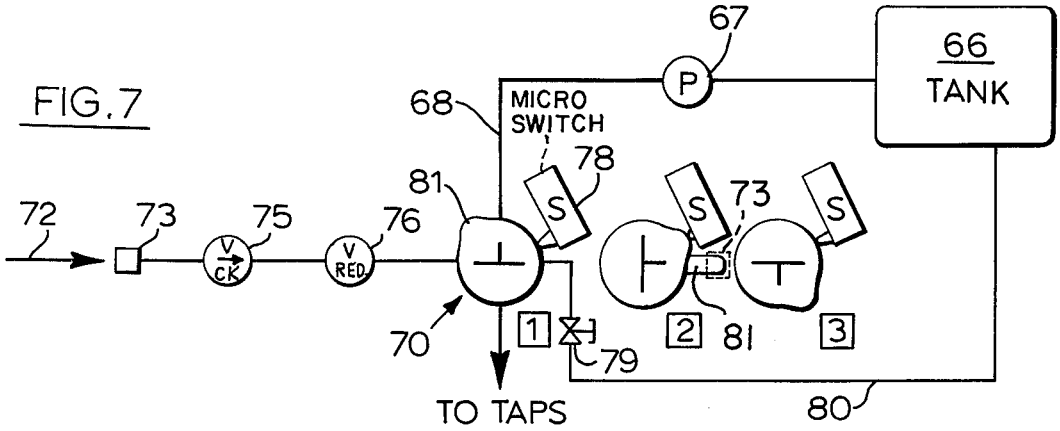

FAUCET ASSEMBLY

This invention relates generally to faucets and control valves for water or other liquid systems, and finds applicability in general pressurized distribution water systems as well as the self-contained liquid supply systems such as those which are utilized in boats, trailers, and living quarters located in isolated areas.

Normal or standard water faucets are well known and universally employed. Also familiar is the problem of leakage and dripping from conventional faucets due to failure of the user to exert sufficient torque in turning the faucet off. A typical dripping faucet can waste an enormous amount of water over the course of a year, and if the dripping tap is a hot water tap the wastage is not only in water but also in the energy consumed to heat the water.

One embodiment of this invention has a feature which reduces or eliminates leakage or dripping in faucets, and thus is able to effect considerable savings in terms of water and energy.

Prior developments also include the arrangement disclosed in U.S. Pat. No. 3,700,002, issued Oct. 24, 1972 to Colin McMaster-Christie and entitled "LIQUID SUPPLY SYSTEM WITH MOTOR OPERATED PUMP ACTUATED BY SWITCH CONTROLLED BY ON-OFF VALVE IN SYSTEM." In this prior system, a tap is provided which has an electrical switch associated with it for controlling a pump which is adapted to pump water from a reservoir to the tap. The components of the tap are arranged in such a way that when the tap is turned on, but before the opening of the valve is initiated, the switch is closed to energize the motor driving the pump, such that the system becomes pressurized before the outlet valve is opened. Continued opening of the tap opens the valve to permit water to be discharged. When the tap is turned off, the valve is closed before the switching opens, such that the pump will continue to operate for a short time after the tap valve is closed, thereby preventing the pump from losing its prime.

It is quite important to avoid loss of prime particularly for non-self-priming pumps such as centrifugal pumps. A problem however arises in this connection, when the water in the reservoir is depleted. When the water level in the reservoir drops to the location of the outlet from the reservoir, air is allowed to enter the pipe or conduit leading to the pump, and this air becomes entrapped in the pump and causes the pump to lose its prime. What will happen in a situation of this kind is that an air-lock will develop in the pump with air in the line from the reservoir to the inlet of the pump, but with the conduit running from the pump to the tap still filled with water. Depending upon the different levels of the components of the system, the pump can often be reprimed by allowing the water in the line between the pump and the tap to run backwards through the line toward the reservoir. This will force the air-lock through the feedline in the reverse direction and cause the pump to be properly primed.

With the system disclosed in the above-mentioned U.S. Pat. No. 3,600,002, however, the tap or valve becomes completely closed before the pump stops operating. This means that, if the operator were to attempt to open the tap to permit the water in the line between the pump and the tap to run in the reverse direction through the pump and purge the air-lock from the system, the fact that the pump is running would not allow the water to run in the reverse direction. What is necessary is an arrangement whereby the pump is "off" but the valve is open. With such an arrangement, the pump would not interfere with the water running in the reverse direction to purge the air-lock from the system.

It is aspect of another embodiment of this invention to allow the specialized arrangement in which the valve or tap is open but the pump is "off."

Another difficulty with the system disclosed in U.S. Pat. No. 3,700,002 relates to the fact that it is possible for the operator to close the tap only to the point where the valve in the liquid passageway is shut, but the pump motor is still running. This of course constitutes a waste of energy, since the pump is running to no good purpose, since no liquid is being taken from the system.

It is a further feature of an embodiment of this invention to overcome the last-mentioned disadvantage.

Finally, in connection with the self-contained liquid supply systems such as those utilized in boats, trailers and the like, it often happens that the owner of the vehicle is able to station it at a location where access may be had to a larger pressurized system. Such pressurized water outlets are often available in marinas, trailer parks, and so forth. In such instances, it would be of advantage for the owner of the vehicle to be able to tie his vehicle water system directly into the pressurized outlet and to be able to turn his taps or faucets on without causing his vehicle pump motor to run. Naturally, it would also be desirable to be able to fill the vehicle reservoir from the outside pressurized system utilizing at least part of the conduit running between the faucet and the reservoir, since this reduces the number of conduits or pipes required. However, the pump necessary to pump water from the reservoir to the tap when the vehicle is in isolation is located in that same line, and therefore it is desirable to, in effect, incapacitate the pump during the time the reservoir is being filled from the outside pressurized system.

A further embodiment of this invention aims at achieving the last-mentioned advantages.

Accordingly, a first embodiment of this invention provides a faucet assembly which comprises structure defining a fluid passageway, valve means adapted to close and open said fluid passageway, a shaft adapted on rotation to operate said valve means and resilient biasing means to induce the shaft to rotate in the direction closing the valve means whenever the shaft is less than a given angle away from its position corresponding to full closure of the valve means, said given angle corresponding to a condition in which the passageway is at least partly opened.

This invention further provides a water system comprising a reservoir, a pump, an electric motor operatively connected to said pump, a faucet assembly which includes structure defining a fluid passageway, a valve means adapted to close and open said fluid passageway, a shaft adapted on rotation to operate said valve means, cam means attached to said shaft, and switch means operated by the cam means upon rotation thereof with the shaft, the cam means and switch means being arranged and configured such that when the valve means fully closes the fluid passageway the switch means is "off" and after the shaft has rotated through a small angle the switch means is "on," and resilient biasing means to induce the shaft to rotate in the direction closing the valve means whenever the shaft is less than a given angle away from its position corresponding to full closure of the valve means, said given angle corresponding to a condition in which the switch means is "on" and the passageway is at least partly opened; and conduit means interconnecting the reservoir, the pump and the faucet assembly.

In a further embodiment, this invention provides a faucet assembly comprising structure defining a fluid passageway, valve means adapted to close and open said fluid passageway, a shaft adapted on rotation to operate said valve means, cam means attached to said shaft and switch means operated by the cam means upon rotation thereof with the shaft, the cam means and switch means being arranged and configured such that when the valve means fully closes the fluid passageway the switch means is "off", and after the shaft has rotated through a small angle in the direction to open the valve means the switch means is "on," and resilient stop means adapted to arrest rotation of the shaft at a position wherein the passageway is fully open, the stop means being such as to allow limited further opening rotation of the shaft upon application of additional torque, the said cam means being shaped to again cause the switch means to turn "off" when the shaft has undergone said limited further rotation.

A further embodiment of this invention provides a water system comprising at least one faucet, a reservoir, a pump for pumping water from the reservoir to said at least one faucet and conduit means interconnecting the reservoir, the pump and said at least one faucet; a pump motor; a 3-way T-valve adapted to be connected (a) to a source of water under pressure, (b) to said at least one faucet, and (c) to said reservoir, such that in a first position of the T-valve said source is connected to the reservoir, in a second position thereof the reservoir is connected to said at least one faucet, and in a third position thereof said source is connected to said at least one faucet; a contoured cam in association with said T-valve for rotation therewith; and an override switch controlling the pump motor, said switch having a sensing member riding against the cam, the cam being configured such that the override switch is "off" in said first and third positions and is "on" in said second position, whereby said pump can operate only when said T-valve is in said second position.

In the accompanying drawings, in which like numerals denote like parts throughout the several views, FIG. 1 is an exploded perspective view of a valve and switch assembly illustrating certain features of this invention;

FIGS. 3–6 are schematic views of some of the components shown in FIG. 1, showing sequential positions in the operation thereof;

FIG. 7 is a schematic view showing the structure and operation of another feature of this invention.

Figure 1:
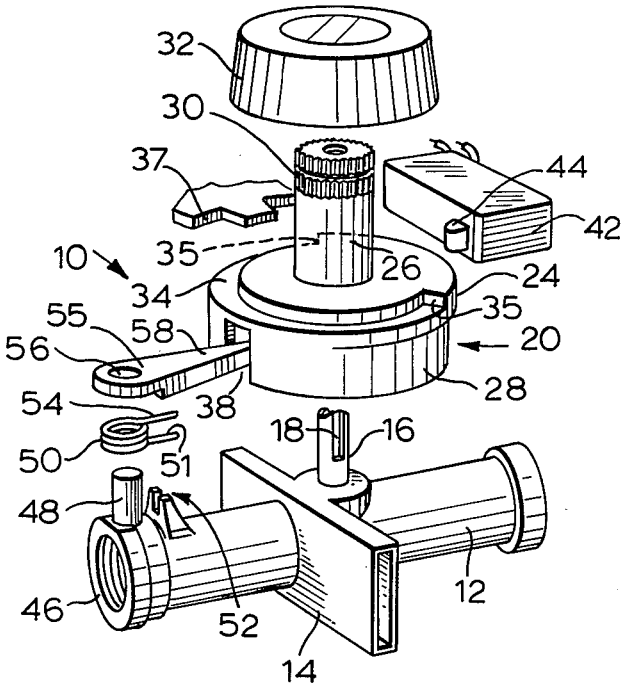
Figure 2:
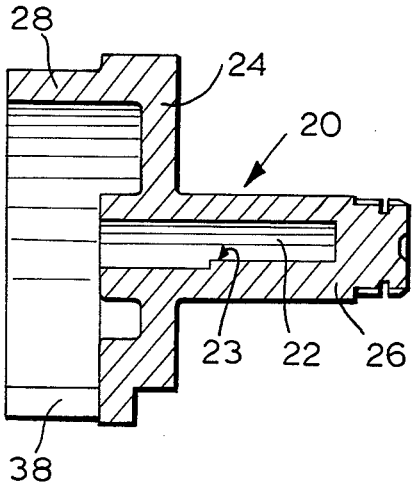
FIG. 2 is an axial sectional view of one component illustrated in FIG. 1.

In FIG. 1 there is shown a faucet or a tap assembly 10 which is seen to include a tubular member 12 having a gate-type closure which includes a transverse integral rectangular channel 14 in which the gate (not seen in the Figure) reciprocates. The gate has an opening therethrough, and is adapted to move between a first position in which the opening is aligned with the central bore of the tubular member 12, and another position in which it is out of alignment with the bore, the gate thus closing the bore in the same manner as a valve. The gate is caused to reciprocate between its two extreme positions by the rotation of a shaft 16 to which is connected a sprocket (not visible) which cooperates with a toothed portion on the gate in the manner of a rack-and-pinion arrangement. As can be seen, the shaft 16 is keyed at 18, and this is for the purpose of permitting the shaft 16 to register in non-rotating relationship with a cam and shaft member 20. As best seen in FIG. 2, the cam and shaft member 20 has an internal bore 22, which includes an integral key 23 adapted to register with the keyway 18 of the shaft 16. Thus, when the member 20 is assembled to the shaft 16, the two rotate together, without slipping. The member 20 includes a circular portion 24, an upstanding shaft 26, and a downwardly depending cam portion 28. At the top of the shaft 26 is a splined or toothed portion 30, for interlocking with a knob 32, or equivalent structure adapted to be grasped and turned by hand.

The circular portion 24 has around a part of its periphery a step 34 which covers only a portion of a complete circle, for example in the region of 240°. As can be seen, the step 34 ends at vertical walls 35, one of which is shown in broken lines behind the shaft 26 in FIG. 1.

It is intended that the step 34 with the end walls 35 thereof cooperate with another component of the assembly, of which only a portion is shown in FIG. 1 as an inwardly projecting rigid tooth member 37. When assembled together, the tooth member 37 projects into the step 34 so that it comes into mechanical interference with the walls 35, thus providing two "stops," determining the maximum angular rotation of the cam and shaft member 20 with respect to other portions of the assembly.

The cam portion 28 is interrupted by an opening 38, which opens downwardly through the bottom rim of the cam portion 28.

Figure 3:
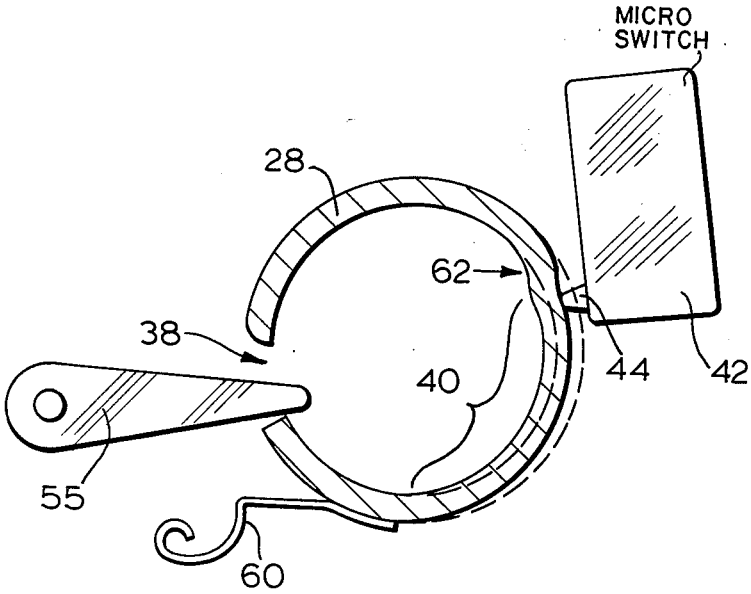

As best seen in FIG. 3, the cam portion 28 is substantially circular for the most part, but includes a region 40 of which the radius gradually decreases in the counterclockwise direction from a location near the bottom of the cam portion 28 as seen in the FIG. 3 representation, to a location at approximately the "2 o'clock" position.

Also forming part of the assembly of FIG. 1 is a micro-switch 42 having a sensing member 44 projection therefrom. In FIG. 1 the micro-switch 42 would appear in its correct horizontal relationship to the other parts if seen from directy above, although the Figure itself shows the switch in exploded relationship somewhat vertically above its true location. When assembled together, the micro-switch 42 is located such that the sensing member 44 bears against the cam portion 28 in the manner shown in FIG. 3.

Attention is now directed to the leftward end of the tubular member 12 in FIG. 1, which is seen to include an internally threaded collar portion 46, from which upwardly extends an integral post 48 which is adapted to receive a coil spring 50 of which one end 51 is receivable between two upwardly extending integral, spaced apart jaws 52. The other end 54 of the spring 50 is adapted to be received in a downwardly opening slot (not visible in FIG. 1) in the underside of a finger member 55 which has a rounded end with an opening 56 adapted to register with the post 48, and which has a pointed end 58 long enough to enter the opening 38 in the cam portion 28, when the cam and shaft member 20 is in an appropriate rotational orientation.

Before discussing the operation and advantages of the structure shown in FIG. 1, it is appropriate to recall one of the disadvantages of the system disclosed in U.S. Pat. No. 3,700,002, touched on earlier in this specification. The system of the U.S. patent is arranged in such a way that if the tap is turned on only sufficiently to close the micro-switch (thus causing the pump to operate), but not sufficiently to open the valve, then the pump will continue to operate indefinitely without doing any useful work, and thus wasting electrical energy. Likewise, when the tap is turned off, it may be turned off only sufficiently to cut off the water flow without opening the micro-switch to cause the pump to shut off. The present invention eliminates this problem by positively biasing the tap to an off position after the tap has been moved close to the closed position, whereby a positive closure of the valve and shut-off of the pump are simultaneously assured. The way in which this is achieved will be explained subsequently.

Another problem associated with the system of U.S. Pat. No. 3,700,002 has also been dealt with, and relates to the risk of getting an air-lock in the pump when the reservoir has been emptied. As previously explained, when the pump is not self-priming (for example a centrifugal pump), there is a serious risk that an air-lock will occur in the pump, because when the reservoir has been drained down to the location of the water outlet from the reservoir, air can enter the pipe running between the reservoir and the inlet of the pump. If the reservoir is subsequently filled without doing anything to remove the air-lock, the air-lock will remain. In the system described in U.S. Pat. No. 3,700,002, the problem is avoided by the provision of a master switch which overrides the tap-controlled switch, and is capable of turning off the pump. To purge an air-lock in the pump, the said master switch is operated to prevent the pump from running, and the tap is opened to permit water contained in the pipe between the outlet side of the pump and the tap to flow back through the pump and force the air-lock into the water reservoir.

The foregoing is a rather complex procedure and the invention disclosed herein is such as to simplify the air-lock purging procedure considerably.

Attention is now directed to FIGS. 3–6, with the help of which the operation of the assembly illustrated in FIGS. 1 and 2 will be further explained.

Firstly it is to be understood that the finger member 55, as seen from above, is biased in the clockwise direction by the spring 50, this having the effect of biasing the cam and shaft member 20 to its furthest counter-clockwise limit position, as determined by contact between the tooth member 37 and the furthermost wall 35 (in broken lines in FIG. 1). It is assumed that FIG. 3 of the drawings illustrates this furthest counter-clockwise limit position for the member 20, and the cam portion 28 which forms a part thereof. In the condition of FIG. 3 it is also assumed that the finger member 55 is still exerting a residual clockwise pressure on the counter-clockwise edge of the opening 38, in order to keep the member 20 firmly pushed to its limit position. In this limit position, it will be seen that the sensing member 44 of the micro-switch 42 is extended to its "off" position, and it is to be understood that the micro-switch 42 controls the operation of a pump which is arranged to pump water from a tank or reservoir to the assembly 10 shown in FIG. 1. It is also to be understood that the furthest counter-clockwise rotary position of the cam and shaft member 20 corresponds with the "off" position of the gate contained within the rectangular channel 14, thereby closing the through-bore in the tubular member 12, and in effect shutting the valve.

Before proceeding to FIG. 4, it should be pointed out that a spring member 60 is secured to the cam portion 28 at about the location shown. The spring member 60 projects angularly away from the surface of the cam portion 28, and has a purpose which will become clear subsequently in this specification.

Attention is now directed to FIG. 4, which is similar to FIG. 3, but shows the cam portion 28 (and of course the other associated parts of the member 20) after clockwise rotation through an angle of 80° or 90°. The rotation of the cam portion 28 has caused the finger member 55 to come out of the opening 38, and it can be seen in FIG. 4 as simply resting in biased relation against the outer surface of the cam portion 28. During the rotation from the FIG. 3 to the FIG. 4 condition, the finger member 55 would continue to exert a counter-clockwise biasing pressure on the cam portion 28 up to the moment when it slips out of the opening 38. At that point, the biasing pressure on the cam portion 28 suddenly ceases. It will also be seen in FIG. 4 that the sensing member 44 of the micro-switch 42 has been caused to "ride up" over the "hill" 62 in the surface of the cam portion 28, and now presses against a part of the surface of the cam portion 28 of a greater radius, thereby turning the micro-switch 42 on and causing the pump to operate. It will further be seen from the close spacing in FIG. 3 between the "hill" 62 and the sensing member 44, that the micro-switch 42 is turned on (thus starting the pump) before the finger member 55 leaves the opening 38, i.e. before the counter-clockwise biasing pressure exerted on the cam portion 28 ceases. Another event also takes place before the counter-clockwise biasing pressure exerted on the cam portion 28 ceases, and this is the initiation of the opening of the gate forming part of the valve closure for the tubular member 12. Because of this arrangement, it does not matter whether the micro-switch 42 closes before the gate valve begins to open, or vice versa. The important thing is that, over the full rotational range during which the micro-switch 42 is switched and during which the gate valve begins to open, the finger member 55 exerts a counter-clockwise biasing pressure on the cam portion 28. It will thus be understood that, when the point is reached where the end of the finger member 55 is just emerging from the opening 38, the gate valve will be already partially open (only a minor amount of opening is sufficient), and the pump will be running. As the cam portion 28 (and thus the member 20) is rotated further in the clockwise direction through the conditions shown in FIGS. 4 and 5, the gate valve will continue to open further, and the pump will remain on. In FIG. 5, it can be seen that the spring member 60 has come around into contact with a corner of the micro-switch 42. This constitutes in effect a limit or "stop" which is sensed by the person operating the tap, and which in effect determines the "full open" position of the tap. It will be seen that, as the cam portion 28 rotates through the FIG. 4 position to that shown in FIG. 5, the sensing member 44 of the micro-switch 42 remains depressed thus keeping the pump on. At the condition shown in FIG. 5, the sensing member 44 is just adjacent the opening 38 which has been swung around almost a full 180° from the situation shown in FIG. 3. The contact between the spring member 60 and the micro-switch 52 however, prevents the operator from rotating the cam portion 28 a few degrees further so that the sensing member 44 enters the opening 38, and thus shuts off the pump. However, if the operator should apply positive clockwise rotational pressure to the knob 32 and thus to the cam and shaft member 20, it will be possible to bend the spring 60 as shown in FIG. 6 so that the sensing member 44 does enter the opening 38, thus shutting off the pump. The purpose of this capability of turning off the pump while the gate valve is fully open will be explained in a moment. First however it is instructive to trace the portions shown in FIGS. 3–5 as the tap is closed, i.e. as the cam portion 28 is rotated in the counter-clockwise direction from FIG. 5 through FIG. 4 to the shut-off position of FIG. 3. To begin with, rotation from the FIG. 5 to the FIG. 4 orientation will merely progressively close off the gate valve, while the pump continues to run, the supplying water to the tap. Shortly beyond the FIG. 4 orientation, however (in the counter-clockwise direction), the pointed end of the finger member 55 will enter the opening 38 and will instantly exert a counter-clockwise biasing torque against the cam portion 28, thus quickly rotating the same in the counter-clockwise direction to the FIG. 3 condition. Between the initial "grab" of the finger member 55 and the final position shown in FIG. 3, two events will take place. One is the opening of the micro-switch 42 and thus the shutting off of the pump, while the other is the complete closure and shutting off of the gate valve. It will thus be understood that the operator of the tap will find that the flow of water can be gradually reduced to a given minimum level by counter-clockwise rotation of the knob 32, but that once this minimum level is achieved the cam and shaft member 20 of the knob 32 are suddenly subjected to a closing torque due to the exertion of the finger member 55. As these portions rotate under the applied torque, the operator will see the trickle of water completely shut off and will (probably) hear the pump shut off as well.

In a case where, upon opening the tap, the switch closes before the valve begins to open, it will be understood that it will be impossible for the operator to "leave" the tap in a condition representing a point between these two events, i.e. a condition in which the valve is closed but the switch is still "on" with the motor running. This is due to the fact that the resilient biasing finger 55 exerts positive closure torque over the full range between the two events just mentioned.

Similarly, in the case of the reverse sequence for the switch and valve, it will again be impossible for the operator to "leave" the tap in a condition in which the switch is off and the motor not running, but the valve is still partly open. Again, this is due to the fact that the resilient biasing finger 55 exerts positive closure torque over this entire range.

Attention is once more directed to FIG. 6. When the respective components are in the condition shown in FIG. 6, the gate valve is fully open and the pump is off. This satisfies the two conditions necessary for purging an air-lock in the reverse direction through the pump. More specifically, the pump is off, thus no longer urging water in the direction from the reservoir to the tap, and the tap itself is open, thus permitting water located in the line between the tap and the pump to move backwardly through the pump and into the portion of the line between the reservoir and the pump, thus expelling the air-lock into the reservoir.

It will be understood that the specific components shown in FIGS. 3–6 could be arranged in such a way that the sensing member 44, instead of dropping into the opening 38, drops into an earlier depression of pocket, such as the pocket shown in broken lines by the numeral 63 in FIG. 4. Naturally, with the provision of an "earlier" pocket 63 for the sensing member 44, the spring member 60 would have to be relocated so as to contact the micro-switch 42 earlier in the rotation of the cam portion 28.

It will also be understood that the spring member 60 would have to be located at a vertical level against the outer surface of cam portion 28 sufficient to clear the finger member 55. In other words, these two would have to be arranged so as to eliminate the risk of mechanical interference.

The third feature of this invention relates to the situation arising when a boat docks at a marina or a trailer arrives at a camp ground. In either of these conditions, the trailer or boat owner usually will refill his water reservoir, and while at the dock or camp ground generally will take water directly from the city water supply rather from his own water reservoir. In conventional systems presently available, a number of adjustments have to be made by the boat or trailer owner depending upon whether he wants to go on city water, refill his reservoir tank, or take water from his reservoir tank. Thus, the third feature of this invention provides a much simpler system than is currently available for achieving these objectives, and the same is illustrated schematically in FIG. 7. In FIG. 7 a reservoir tank 66 is adapted to provide water to be pumped by pump 67 along a line 68 to a three-way valve which is shown schematically at 70. A line 72 carries pressurized city water through a connector 73, a one-way check valve 75, and a pressure reducing valve 76 (if needed). From the pressure reducing valve 26, the city water is carried to a second connection on the valve 70. A third connection leads to the taps on the boat or in the trailer, while a fourth connection connects through a shut-off valve 79 to a filling line 80 leading to the tank 66.

In certain applications the filling line 80 may not be required, but the operation which is described below will be seen to be independent of the presence of the filling line 80. The filling line 80 is provided where in-place systems include a tank and a pump and also include a one-way check-valve in the line 68 leading from the pump to the valve 70, in order to prevent flow in the reverse direction from the valve 70 to the tank 66. In such cases, the filling line 80 may be connected from the outlet of the valve 79 to a suitable filling aperture in the tank 66. However, where the check-valve is not present in the line 68, and where the pump 67 is a centrifugal pump through which water can flow in the reverse direction, there is no need for the filling line 80, and such need not be provided.

The valve 70 is shown three times in FIG. 7, identified by the numerals 1, 2 and 3. These positions are associated with the following operational modes. In position number 1 of the valve 70, city water from the source line 72 passes either along line 68 through the pump 67 to fill the tank 66, or (if there is a one-way check-valve in the line 68 which prevents flow in the reverse direction) through the valve 79 and filling line 80 to the tank 66. In this mode, the connection to the taps is closed.

In position number 2 of the valve 70, water in the tank 66 can be pumped by the pump 67 directly to the taps in the boat or trailer, and the city water connection is closed. In position number 2, it will be understood that the valve 79 would be shut off in order to prevent shortcircuiting of the water from the tank back along the filling line 80.

In position number 3, the city water is connected directly to the taps of the boat or trailer, and the connection to the pump 67 and the tank 66 is closed. Again in position number 3, it will be understood that the valve 79 will have to be closed to prevent water passing from the city water system to the filling aperture of the tank 66.

Where the line 80 is not provided (i.e. where there is no check-valve in the line 68 and where the pump 67 is a centrifugal pump), the above modes may be read by ignoring the mention of the valve 79 of the filling line 80.

In accordance with the third feature of this invention, a micro-switch 78 is provided at a fixed location with respect to the rotational axis of the valve 70, and the micro-switch 78 constitutes a master overriding control for the pump 67. For example the micro-switch 78 could be wired in series with the primary switch controlling the motor of the pump, i.e. the switch 42 shown in FIG. 1.

The rotary element of the valve 70 has associated with it an outwardly projecting cam surface 81 which when aligned with the sensing element of the micro-switch 78 turns the latter on, which permits the pump 67 to be energized whenever the tap (discussed in relation to the earlier Figures) is turned on. The micro-switch 78 is turned on only in position number 2, where the flow of water is adapted to pass directly from the tank 66 through the pump 67 to the taps in the trailer or boat. In both of the other conditions, the overriding micro-switch 78 is off, whereby the opening of one of the taps or valves discussed in connection with the earlier Figures will not energize pump 67 (since it is not needed in either case).

In a preferred embodiment of the third feature of this invention, the valve 70 will be mounted in close association with the standard connector 73, and the rotary portion of the valve 70 will have an outwardly projecting finger or "mask" portion 81 adapted to be situated in front of the connector 73 whenever the valve is in position number 2, namely the position where water to the taps is coming directly from the tank 66. This will prevent dirt and dust from entering the connector 73 under these circumstances. In the other two positions of the valve 70, of course, a hose from the city water connection would be coupled to the connector 73, thus eliminating any problem of dirt or dust contamination in this respect.

Figure 8:
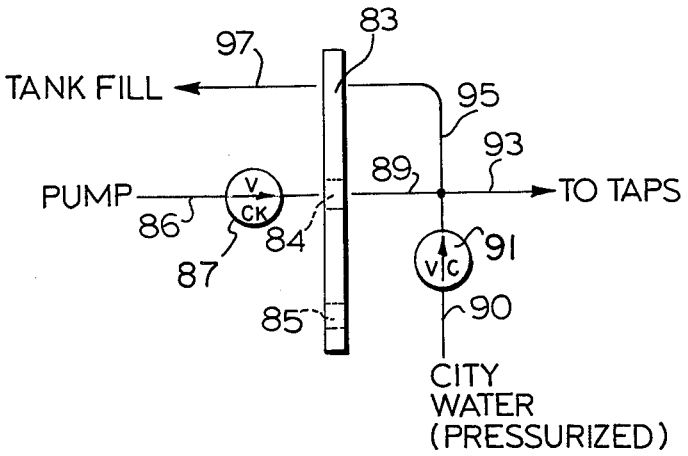
FIGS. 8, 9 and 10 are sequential schematic views of a suitable valving arrangement which may be used in the practice of this invention.
Figure 9:
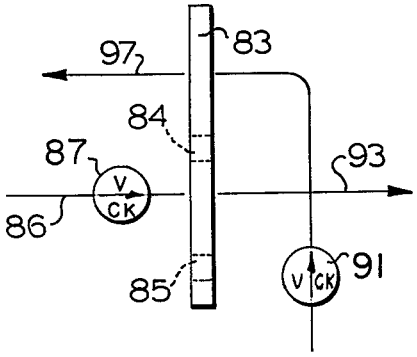
Figure 10:
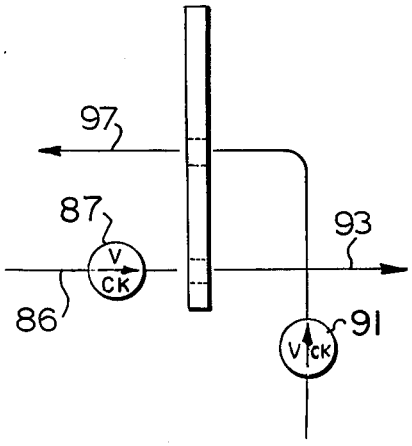

Attention is now directed to FIGS. 8–10, which show schematically a valve construction which may be substituted for the valve 70 in FIG. 7. These figures illustrate the operative portions of a valve which includes a sliding gate 83 having two apertures 84 and 85 therethrough.

A line 86 from the pump leads through a check-valve 87 and can pass water directly through to the line 89 whenever one of the apertures 84 and 85 is in alignment with these two lines. City water comes in through a line 90 and through a check-valve 91 to be directly connected to the line 89. Both of these are in full communication with a line 93 which goes to the taps in the boat or trailer. A further line 95 is in complete communication with the tap, the city water and the line 89, and leads up against the gate 83 so as to be blocked thereby in certain of its positions. On the other side of the gate 83, the line 95 communicates through to a line 97 which passes to the filling opening of the tank.

In the particular position shown in FIG. 8, the opening 84 is interposed in alignment between the lines 86 and 89, such that water can be pumped directly from the tank to the taps. The water cannot get out into the city water system due to the check valve 91, and cannot recirculate back to the tank fill due to the fact that there is no aperture allowing communication between the lines 95 and 97. Thus FIG. 8 represents the mode in which water from the tank can be pumped to the taps. This corresponds to the position number 2 in FIG. 7, in which the microswitch 78 is "on" and allows energization of the pump 67.

In FIG. 9 the gate 83 is in an intermediate position, in which neither of the openings 84 and 85 is interposed in any of the lines. Thus, water cannot be pumped from the tank along line 86, and water cannot be recirculated to fill the tank along line 97. However water from the city water system can pass through the check-valve 91 and along line 93 to the taps. FIG. 9 corresponds to position 3 in FIG. 7, in which the microswitch 78 is "off," preventing operation of the pump 67.

FIG. 10 shows a condition in which the two apertures 84 and 85 are interposed against the lines 97 and 86, respectively. In this mode, water from the city water system under pressure can pass through the check-valve 91 and along the filling line 97 to fill the tank. Water from the city water system could not pass along the line 86 due to the presence of the check-valve 87. At the same time in FIG. 10, water from the city water system could pass out along line 93 to the taps, if these should be turned on. FIG. 10 corresponds to some extent to position 1 in FIG. 7, and certainly in this mode the microswitch 78 would be turned "off," so that the accidental opening of one of the taps during the filling operation would not call upon the pump 67 to pump against a closed gate.

SUMMARY OF ADVANTAGES

FIGS. 1–6 of the drawings illustrate an arrangement which involves partial biasing by the resilient biasing finger 55, a micro-switch 42 adapted to turn the pump motor on or off, and an option, at the fully open condition of the valve, of shutting down the pump in order to permit water in the line between the pump and the tap to purge an air-lock from the pump in the reverse direction through the reservoir. It is to be understood that the provision of the resilient biasing finger 55 alone leads to advantages in particular circumstances, which advantages do not require the presence of the other components and features just mentioned. For example, in the common domestic water distribution system in a house, where the system is at all times pressurized by the local authority, no pump or switch controlling a pump would be required. In this situation, the resilient biasing finger 55 would by itself provide the advantage of fully shutting the tap off whenever the use had rotated it close to the "closed" position. In this way, dripping and leakage through taps, with the attendant waste of water and energy, can be greatly reduced or eliminated.

Similarly, advantages are present in the case of an isolated system utilizing a pump, when the micro-switch 42 and the valve-open switching option are present, even though the resilient biasing finger 55 may be absent. In other words, the provision of the option, at the fully open condition of the valve, of shutting off the pump motor permits the advantage of being able to purge an air-lock in the reverse direction through a pump, whether or not the resilient biasing finger 55 is present.

Finally, the three-way T-valve arrangement and system illustrated in FIG. 7 and described earlier in this specification provides its own particular advantages whether or not a resilient biasing finger 55 is provided to produce positive closure at the lower end of the faucet range, and whether or not the valve-open option is provided for allowing reverse purging of a air-lock through the pump.

I claim:

1. A faucet assembly comprising:

structure defining a fluid passageway, valve means adapted to close and open said fluid passageway, a shaft adapted on rotation to operate said valve means, and (resilient biasing means to induce the shaft to rotate) pivoted biased probe means for interacting with a recess which rotates with said shaft to positively rotate the shaft in the direction closing the valve means whenever the shaft is less than a given angle away from its position corresponding to full closure of the valve means, said given angle corresponding to a condition in which the passageway is at least partly opened, and being less than the full rotational range for the shaft.

2. The invention claimed in claim 1, which includes a substantially cylindrical member fixed coaxially of said shaft and defining an outer surface, the outer surface being interrupted to define an opening constituting said recess, the (resilient biasing) probe means (including) being a finger member pivoted with respect to said structure and located so as to contact the said surface and to enter said opening when the mutual positioning of the finger member and surface is appropriate, the finger member being resiliently biased to push the opening in the direction which will rotate the cylindrical member in the sense which will cause the valve means to close the fluid passageway.

3. The invention claimed in claim 2, in which the substantially cylindrical member further defines cam means, there being further provided switch means operated by the cam means upon rotation of the shaft, the cam means being arranged and configured such that when the valve means fully closes the fluid passageway the switch means is "off" and after the shaft has rotated through a small angle in the valve-opening direction the switch means is "on," the switching "on" of the switch means occurring while the (resilient biasing) probe means is urging the shaft to close the valve means.

4. The invention claimed in claim 3, in which the sequence of events as the shaft rotates in the opening direction from being fully closed is:

(a) the switch means switches "on,"

(b) the valve means beings to open the passageway, (c) the (resilient biasing) probe means ceases to urge the shaft in the closing direction.

5. The invention claimed in claim 3, in which the sequence of events as the shaft rotates in the opening direction from being fully closed is:

(a) the valve means begins to open the passageway, (b) the switch means switches "on,"

(c) the (resilient biasing) probe means ceases to urge the shaft in the closing direction.

6. The invention claimed in claim 1, which further includes cam means attached to said shaft and switch means operated by the cam means upon rotation thereof with the shaft, the cam means and switch means being arranged and configured such that when the valve means fully closes the fluid passageway the switch means is "off" and after the shaft has rotated through a small angle in the valve-opening direction the switch means is "on," the switching "on" of the switch means occurring while the (resilient biasing) probe means is urging the shaft to close the valve means.

7. A water system which includes a faucet assembly as defined in claim 6, a pump for pumping water from a water source to said faucet assembly, and an electric motor operatively connected to said pump, the said switch means controlling the operation of said electric motor.

8. A water system comprising:

a reservoir, a pump, an electric motor operatively connected to said pump, a faucet assembly which includes structure defining a fluid passageway, valve means adapted to close and open said fluid passageway, a shaft adapted on rotation to operate said valve means, cam means attached to said shaft, and switch means operated by the cam means upon rotation thereof with the shaft, the cam means and switch means being arranged and configured such that when the valve means fully closes the fluid passageway the switch means is "off" and after the shaft has rotated through a small angle the switch means is "on," and (resilient biasing) pivoted biased probe means for interacting with a recess which rotates with said shaft to positively rotate (to induce) the shaft (to rotate) in the direction closing the valve means whenever the shaft is less than a given angle away from its position corresponding to full closure of the valve means, said given angle corresponding to a condition in which the switch means is "on" and the passageway is at least partly opened, and being less than the full rotational range for the shaft, and conduit means interconnecting the reservoir, the pump and the faucet assembly.

9. The invention claimed in claim 8, in which the valve means is a gate-type sliding valve which is opened and closed by a rack-and-pinion engagement with a pinion affixed to said shaft.

10. The invention claimed in claim 8, in which said cam means is defined by an approximately cylindrical member coaxial with said shaft and affixed thereto, the cylindrical member defining an outer surface interrupted to provide an opening, the (resilient biasing) probe means including a finger member pivoted with respect to said structure and located so as to contact the said surface and to enter (said) an opening constituting said recess when the mutual orientation of finger member and surface is appropriate, the finger member being resiliently biased to push the opening in the direction which will rotate the cylindrical member in the sense which will cause the valve means to close the fluid passageway.

11. The invention claimed in claim 10, in which the sequence of events as the shaft rotates in the opening direction from being fully closed is:

(a) the switch means switches "on,"

(b) the valve means begins to open the passageway, (c) the (resilient biasing) probe means ceases to urge the shaft in the closing direction.

12. The invention claimed in claim 10, in which the sequence of events as the shaft rotates in the opening direction from being fully closed is:

(a) the valve means begins to open the passageway, (b) the switch means switches "on,"

(c) the (resilient biasing) probe means ceases to urge the shaft in the closing direction.

13. The invention claimed in claim 10, in which the switch means is a switch mounted adjacent to said cylindrical member with a sensing member bearing resiliently against part of said outer surface of the cylindrical member, the outer surface having an inward depression which allows the sensing member to shift outward from the switch and turn the switch "off," the engagement of the sensing member with the depression corresponding to substantial closure of the passageway by the valve means.

14. The invention claimed in claim 13, in which the pump is a non-self-priming pump, and in which resilient stop means is provided to arrest rotation of the shaft at a position in which the passageway is fully open, the stop means being yieldable to allow limited further opening rotation of the shaft upon application of sufficient torque thereto, the said outer surface of the cylindrical member having a recess for receiving the sensing member and thus turning the switch "off" when the shaft has undergone said limited further rotation, whereby a condition can be attained in which the pump motor is off and the passageway is open.

15. The invention claimed in claim 14, in which there is provided a three-way T-valve adapted to be connected (a) to a source of water under pressure, (b) to said faucet assembly, and (c) to said reservoir; such that in a first position of the T-valve said source is connected to the reservoir, in a second position thereof the reservoir is connected to said faucet assembly, and in a third position thereof said source is connected to said faucet assembly, a contoured cam in association with said T-valve for rotation therewith, and an override switch with a sensing member riding against the cam, the cam being shaped such that the override switch is "off" in said first and third positions and is "on" in said second position, the override switch being wired to control said switch means whereby said pump can operate only when said three-way T-valve is in said second position.

16. The invention claimed in claim 15, in which the T-valve is mounted adjacent a connection adapted to be engaged by a conduit bringing water from said source, the T-valve including a masking finger portion rotatable therewith and adapted, whenever the T-valve is in said second position, to cover the connector opening to prevent the ingress of dirt, grease, and other contaminants.

17. The invention claimed in claim 15, in which the three-way T-valve has a fourth connection (d) through a shut-off valve along a filling line to said reservoir to fill the same, and in which the conduit means interconnecting the reservoir, the pump and said at least one faucet resists liquid movement in the reverse direction from the pump to the reservoir when the pump is shut off.

18. The invention claimed in claim 8, in which the pump is a non-self-priming pump, and in which resilient stop means is provided to arrest rotation of the shaft at a position in which the passageway is fully open, the stop means being such as to allow limited further opening rotation of the shaft upon application of additional torque, the same cam means being shaped to again cause the switch means to turn "off" when the shaft has undergone said limited further rotation, whereby a condition can be attained in which the pump motor is off and the passageway is open.

19. The invention claimed in claim 8, in which there is provided a three-way T-valve adapted to be connected (a) to a source of water under pressure, (b) to said faucet assembly, and (c) to said reservoir; such that in a first position of the T-valve said source is connected to the reservoir, in a second position thereof the reservoir is connected to said faucet assembly, and in a third position thereof said source is connected to said faucet assembly, a contoured cam in association with said T-valve for rotation therewith, and an override switch with a sensing member riding against the cam, the cam being shaped such that the override switch is "off" in said first and third positions and is "on" in said second position, the override switch being wired to control said switch means whereby said pump can operate only when said three-way T-valve is in said second position.

20. The invention claimed in claim 19, in which the T-valve is mounted adjacent a connection adapted to be engaged by a conduit bringing water from said source, the T-valve including a masking finger portion rotatable therewith and adapted, whenever the T-valve is in said second position, to cover the connector opening to prevent the ingress of dirt, grease, and other contaminants.

21. The invention claimed in claim 8, in which there is provided a T-valve adapted to be connected (a) to a source of water under pressure, (b) to said faucet assembly, (c) to the pump, and (d) to a filling line leading to said reservoir; such that in a first position of the T-valve said source is connected to said filling line and to said pump, in a second position thereof the reservoir is connected through the pump to said faucet assembly, and in a third position thereof said source is connected to said faucet assembly, a contoured cam in association with said T-valve for rotation therewith, and an override switch with a sensing member riding against the cam, the cam being shaped such that the override switch is "off" in said first and third positions and is "on" in said second position, the override switch being wired to control said switch means whereby said pump can operate only when said T-valve is in said second position.

22. The invention claimed in claim 8, in which there is provided a valve adapted to be connected (a) to a source of water under pressure through a one-way check-valve allowing water to pass only from said source to said valve, (b) to said faucet assembly, (c) to said pump through a one-way check-valve allowing water to pass only from said pump to said valve, and (d) to a filling line leading to said reservoir; the valve including a sliding gate having two spaced-apart apertures, the gate having three basic positions which include (1) a position in which one aperture is interposed between and allows communication between the pump and the faucet assembly and in which the filling line leading to the reservoir is closed by the gate, (2) a position in which the filling line is closed by the gate and in which the line leading from the pump to the faucet assembly is also closed by the gate, and (3) a position in which the two apertures are aligned respectively with the filling line and with the line leading from the pump to the faucet assembly; cam means being provided in association with said valve and an override switch with a sensing member riding against the cam, the structure of the last-mentioned elements being such that the override switch is "off" in positions (2) and (3), and is "on" in position (1), the override switch being wired to control said switch means whereby said pump can operate only when said valve is in said position (1).

23. A faucet assembly comprising:

structure defining a fluid passageway, valve means adapted to close and open said fluid passageway, a shaft adapted on rotation to operate said valve means, cam means attached to said shaft and switch means operated by the cam means upon rotation thereof with the shaft, the cam means and switch means being arranged and configured such that when the valve means fully closes the fluid passageway the switch means is "off", and after the shaft has rotated through a small angle in the direction to open the valve means the switch means is "on,"

and resilient stop means adapted to arrest rotation of the shaft at a position wherein the passageway is fully open, the stop means being such as to allow limited further opening rotation of the shaft upon application of additional torque, the said cam means being shaped to again cause the switch means to turn "off" when the shaft has undergone said limited further rotation.

24. A water system which includes a faucet assembly as defined in claim 23, a pump for pumping water from a water source to said faucet assembly, and an electric motor operatively connected to said pump, the switch means controlling operation of said electric motor.

25. The invention claimed in claim 24, in which the shaping of said cam means to again cause the switch means to turn "off" when the shaft has undergone said limited further rotation is constituted by a recess in the cam means for receiving said sensing member.

26. A water system comprising:

at least one faucet, a reservoir, a pump for pumping water from the reservoir to said at least one faucet and conduit means interconnecting the reservoir, the pump and said at least one faucet, a pump motor, a three-way T-valve adapted to be connected (a) to a source of water under pressure, (b) to said at least one faucet, and (c) to said reservoir, such that in a first position of the T-valve said source is connected to the reservoir, in a second position thereof the reservoir is connected to said at least one faucet, and in a third position thereof said source is connected to said at least one faucet;

a contoured cam in association with said T-valve for rotation therewith;

and an override switch controlling the pump motor, said switch having a sensing member riding against the cam, the cam being configured such that the override switch is "off" in said first and third positions and is "on" in said second position, whereby said pump (cam) can operate only when said T-valve is in said second position.

27. The invention claimed in claim 26, in which the three-way T-valve has a fourth connection (d) through a shut-off valve along a filling line to said reservoir to fill the same, and in which the conduit means interconnecting the reservoir, the pump and said at least one faucet resists liquid movement in the reverse direction from the pump to the reservoir when the pump is shut off.

28. The invention claimed in claim 26, in which the T-valve is mounted adjacent a connection adapted to be engaged by a conduit bringing water from said source, the T-valve including a masking finger portion rotatable therewith and adapted, whenever the T-valve is in said second position, to cover the connector opening to prevent the ingress of dirt, grease, and other contaminants.

29. The invention claimed in claim 26, in which a primary switch controlling the pump motor is adapted to be turned "on" when said at least one faucet is opened, and "off" when said at least one faucet is shut, the said override switch being wired such that both said primary switch and said override switch must be "on" in order for the pump motor to run.

* * * * *